US008350477B2

(12) United States Patent
Maehara et al.

(10) Patent No.: US 8,350,477 B2
(45) Date of Patent: Jan. 8, 2013

(54) CERAMIC METAL HALIDE LAMP WITH LENGTH TO DIAMETER RATIO

(75) Inventors: Akiyoshi Maehara, Saitama (JP); Shigeyuki Aoki, Saitama (JP); Motonori Hamano, Saitama (JP)

(73) Assignee: Iwasaki Electric Co., Ltd., Tokyo (JP)

( * ) Notice: Subject to any disclaimer, the term of this patent is extended or adjusted under 35 U.S.C. 154(b) by 0 days.

(21) Appl. No.: 13/258,116

(22) PCT Filed: Apr. 19, 2010

(86) PCT No.: PCT/JP2010/056903

§ 371 (c)(1),
(2), (4) Date: Nov. 18, 2011

(87) PCT Pub. No.: WO2010/122970

PCT Pub. Date: Oct. 28, 2010

(65) Prior Publication Data

US 2012/0056533 A1 Mar. 8, 2012

(30) Foreign Application Priority Data

Apr. 20, 2009 (JP) ..... 2009-102216

(51) Int. Cl.
*H01J 17/16* (2006.01)
*H01J 61/30* (2006.01)

(52) U.S. Cl. ..... 313/634; 313/640

(58) Field of Classification Search ..... 313/634, 313/640

See application file for complete search history.

(56) References Cited

U.S. PATENT DOCUMENTS 6,215,254 B1 * 4/2001 Honda et al. ..... 315/246
6,661,176 B2 12/2003 Honda et al.
2002/0135304 A1 * 9/2002 Honda et al. ..... 313/634
2003/0025453 A1 2/2003 Kakisaka et al.
2006/0091812 A1 * 5/2006 Koerber et al. ..... 313/637
2006/0164016 A1 * 7/2006 Rintamaki et al. ..... 313/638
2006/0208643 A1 * 9/2006 Jungst et al. ..... 313/637
2006/0273726 A1 * 12/2006 Lehmann ..... 313/637
2007/0085478 A1 * 4/2007 Dakin et al. ..... 313/571
2007/0243415 A1 10/2007 Yoshioka et al.
2008/0224615 A1 9/2008 Higashi et al.
2009/0029087 A1 1/2009 Ohashi et al.
2009/0224674 A1 * 9/2009 Selezneva et al. ..... 313/623

FOREIGN PATENT DOCUMENTS

| | | |
|---|---|---|
| JP | 5-82099 | 4/1993 |
| JP | 2000-58002 | 2/2000 |
| JP | 2002-245971 | 8/2002 |
| JP | 2003-86131 | 3/2003 |
| JP | 2008-44344 | 2/2008 |
| WO | 2005/096347 | 10/2005 |

* cited by examiner

*Primary Examiner* — Mariceli Santiago
*Assistant Examiner* — Glenn Zimmerman
(74) *Attorney, Agent, or Firm* — Greenblum & Bernstein, P.L.C.

(57) ABSTRACT

High color rendition (Ra≧80) and high efficiency (η≧100 (1 m/W)) which are effects conflicting to each other in a metal halide lamp are attained. An arc tube formed of translucent ceramics, capillaries are formed continuously on the both ends of an arc chamber formed substantially in an ellipsoidal shape in the direction of the longitudinal axis by way of a transition curve with no angled corner, and the arc tube is designed to effective length L/effective inner diameter D of 1.8 to 2.2, and formed to such a size that the lowest temperature of the arc chamber is 800° C. or higher and the highest temperature of the arc chamber is 1200° C. or lower during lighting, and at least thulium iodide, thallium iodide, sodium iodide, and calcium iodide are sealed as metal halides where sodium iodide and calcium iodide are sealed by a molar ratio of 40 to 80% and less than 30%, respectively, based on the entire metal halides.

6 Claims, 6 Drawing Sheets

CERAMIC METAL HALIDE LAMP WITH LENGTH TO DIAMETER RATIO

TECHNICAL FIELD

The present invention concerns a ceramic metal halide lamp used for general illumination in offices, stores, etc. which is used particularly suitably in a case of requiring high color rendition and high efficiency at a correlated color temperature in a range of: 3,000 to 4,500 K, an average color rendering index in a range of: Ra≧80, and at a luminous efficiency in a range of: η≧100 (1 m/W).

BACKGROUND ART

Since metal halide lamps emit light nearest to natural light, they are excellent in color rendition compared with high pressure sodium lamps or mercury lamps and they are used also as basic illumination in offices or stores.

While, light sources, which are generally used, have high color rendition at an average color rendering index Ra of 80 or more that is higher than the same of color-rendering-section 1B of ISO 8995, and have a color range from so-called warm color at a correlated color temperature in a range from 3,000 to 4,500 K, lamps of higher luminous efficiency have been demanded with a view point of energy saving.

However, high color rendition and high efficiency are effects in a trade off relation, that is, the luminous efficiency lowers as the color rendition is improved, whereas color rendition lowers as the luminous efficiency is improved.

Therefore, while it has been stated that existent metal halide lamps have high efficiency and high color rendition, they are classified either to an efficiency-emphasized type or a color rendition-emphasized type.

In this case, they are generally evaluated to have high color rendition when an average color rendering index is in a range of: Ra≧80 and evaluated to have high efficiency when luminous efficiency is about in a range of: η≧100 (color rendition section according to ISO 8995 of 1B or higher).

For example, since the Dy—Ho—Tm type metal halide lamp disclosed in Patent Document 1 shows the average color rendering index of: Ra=87 and the luminous efficiency of η=93 (1 m/W) the highest data, the lamp can be considered as the color rendition-emphasized type.

Further, since the Na—Ce type metal halide lamp disclosed in Patent Document 2 has excellent average luminous efficiency of: η=123 (1 m/W) due to intense green emission of Ce, but has poor color rendition as the average color rendering index is of: Ra=60 the lamp can be considered as the efficiency-emphasized type (refer to [0049] in Patent Document 2).

Further, while Patent Document 2 describes in [0082] that: "in addition to NaI, dysprosium (Dy), thulium (Tm), holmium (Ho), thallium (Tl), etc. may be added as a luminescent material optionally in accordance with desired lamp characteristics", even when the ratio of the luminescent material sealed in the Na—Ce type metal halide lamp is controlled by the addition of the materials described above, it is difficult to increase Ra to 70 or more by suppressing the intense green emission of Ce and, in addition, the lamp characteristics described above approaches to those of the Patent Document 1 to lower the luminous efficiency when Dy, Tm, Ho, Ti are added as the luminescent material.

PRIOR ART DOCUMENT

Patent Document

[Patent Document 1] JP-A No. 2003-187744
[Patent Document 2] JP-A No. 2003-086130)

SUMMARY OF THE INVENTION

Subject to be Solved by the Invention

A technical subject to be solved in the present invention is to make high color rendition and high efficiency compatible which are effects conflicting to each other in metal halide lamps, specifically, to attain high luminous efficiency in a range of: 100 (1 m/W) while maintaining high color rendition of the average color rendering index in a range of: Ra≧80.

Means for Solving the Subject

For attaining the subject, the present invention provides a ceramic metal halide lamp having an arc tube, comprising an arc chamber where a metal halide, mercury, and a starting gas are sealed, and a pair of capillaries each having an electrode assembly inserted therethrough disposed on both ends of the arc chamber, the arc tube and the arc chamber being formed of translucent ceramics, wherein the capillary is formed continuously to each end of the arc chamber formed substantially in an ellipsoidal shape in the direction of the longitudinal axis by way of a transitional curved area with no angled corner, the inner dimension of the arc chamber is designed as:

$$1.8 \leqq L/D \leqq 2.2$$

where

L is an effective length and

D is an effective inner diameter, and the arc chamber is formed to a size that the lowest temperature in an arc chamber is 800° C. or higher and the highest temperature in the arc chamber is 1200° C. or lower during lighting, and at least thulium iodide, thallium iodide, sodium iodide, and calcium iodide are sealed as the metal halides, and sodium iodide and calcium iodide are sealed by a molar ratio of 40 to 80% and less than 30%, respectively, based on the entire metal halide.

Effect of the Invention

According to the metal halide lamp of the present invention, at least four species of metal halide of thulium iodide, thallium iodide, sodium iodides, i.e., and calcium iodide are sealed in the arc tube.

Generally, in Tm—Tl—Na system ceramic metal halide lamps sealed with thulium iodide ($TmI_3$), thallium iodide (TlI), and sodium iodide (NaI) as the metal halide, while $TmI_3$ and TlI that exhibit green emission color improve the luminous efficiency and NaI that exhibits yellow emission color improves the color rendition, they are the efficiency-emphasized metal halide lamp excellent in the luminous efficiency as a whole.

In the invention, NaI is defined as 40 to 80% by molar ratio and calcium iodide ($CaI_2$) is also added.

Since emission in a red region increases by the addition of $CaI_2$, the color rendition is improved but the luminous efficiency tends to be lowered. According to the inventor's experiment, it has found that when the ratio of $CaI_2$ sealed is less than 30%, the luminous efficiency is lowered only slightly and the effect of improving the color rendition is large.

Then, $CaI_2$ is added up to 30% by molar ratio as an upper limit.

Further, since the arc tube is configured such that a pair of capillaries are formed continuously on both ends of the arc chamber formed substantially in an ellipsoidal shape in the direction of the longitudinal axis by way of transitional curved areas, the entire thickness can be made relatively thin and uniform without lowering the mechanical strength and, accordingly, the temperature distribution in the arc chamber is made relatively uniform and the lowest temperature can also be maintained high different from three piece type or five piece type lamps in which a thick portion is formed partially, so that it is not necessary to increase the bulb wall loading.

Further, since the temperature difference inside the arc chamber is decreased than usual and, as a result, the rate of chemical reaction between the metal halide and the material constituting the inner wall surface of the arc chamber can be kept low, this provides an effect capable of extending the lamp life.

Further, the inner size of the arc chamber is designed as $1.8 \leqq L/D \leqq 2.2$ where L is an effective length and D is an effective inner diameter, and is formed to such a size that the lowest temperature in the arc chamber is 800° C. or higher and the highest temperature in the arc chamber is 1200° C. or lower during lighting.

It has been found according to the inventors experiment that even when the arc chamber is formed into an ellipsoidal shape, the aspect ratio and the size thereof give some or other effects on the luminous efficiency and the color rendition. An average color rendering index in a range of: $Ra \geqq 80$, and a luminous efficiency of: $\eta = 100$ (1 m/W) could be attained irrespective of the rated power of the metal halide lamp when the arc tube is designed as: $1.8 \leqq L/D \leqq 2.2$, and formed to a size that the lowest temperature of the arc chamber is 800° C. or higher and the highest temperature of the arc chamber is 1200° C. or lower during lighting.

MODE FOR CARRYING OUT THE INVENTION

According to the present invention, for attaining a high luminous efficiency in a range of: $\eta \geqq 100$ (1 m/W) while maintaining a high color rendition of an average color rendering index in a range of: $Ra \geqq 80$, an arc chamber is provided, in which the capillary is formed continuously to each end of the arc chamber formed substantially in an ellipsoidal shape in the direction of the longitudinal axis by way of a transitional curved area with no angled corner, the inner dimension of the arc chamber is designed as:

$$1.8 \leqq L/D \leqq 2.2$$

where

L is an effective length and

D is an effective inner diameter, and the arc chamber is formed to such a size that the lowest temperature in the arc chamber is 800° C. or higher and the highest temperature in the arc chamber is 1200° C. or lower during lighting, and at least thulium iodide, thallium iodide, sodium iodide, and calcium iodide are sealed as the metal halide, and sodium iodide and calcium iodide are sealed by a molar ratio of 40 to 80% and less than 30%, respectively, based on the entire metal halide.

In the present invention, experiments were performed for each of three types of metal halide lamps A to C shown below while varying the rated power and the molar ratio of materials to be sealed.

<Arc Tube>

Figure 1:
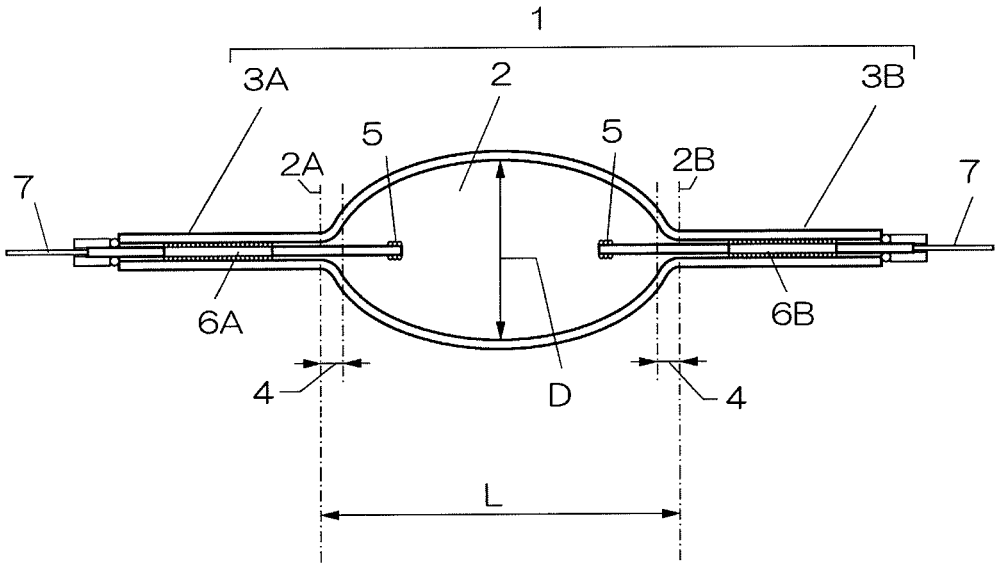
FIG. 1 is an explanatory view showing an arc tube used in a metal halide lamp according to the present invention.

In each of metal halide lamps A to C, an identical arc tube 1 shown in FIG. 1 is used.

The arc tube 1 is configured such that a pair of capillaries 3A, 3B are formed continuously on both ends of an arc chamber 2 formed substantially in a ellipsoidal shape in the direction of a longitudinal axis by way of transition curved area 4 with no angled corner and a metal halide, mercury, and a starting rare gas are sealed in the arc chamber 2.

The arc tube 1 in this embodiment uses a so-called one piece type in which the arc chamber 2 and the capillaries 3A and 3B are formed integrally by molding a powder compressed translucent alumina.

A pair of electrode assemblies 6A, 6B having electrodes 5, 5 are inserted through the capillaries 3A, 3B formed on both ends of the arc chamber 2, in which both ends of the capillaries 3A, 3B are airtightly sealed by a sealant such as frit glass having electric insulating property, and the electrode assemblies 6A, 6B are secured by the sealant to predetermined positions in the capillaries 3A, 3B.

The inner size of the arc chamber 2 is designed as: $1.8 \leqq L/D \leqq 2.2$ where L is an effective length and D is an elective inner diameter.

The effective length L is defined by the distance between portions 2A and 2B where the inner diameter of the straight tubular capillaries 3A, 3B transit to transitional curved areas 4 contiguous to the arc chamber 2 and start to increase the diameter. The effective inner diameter D is defined by the maximum inner diameter at the central portion between the electrodes in the one piece type arc tube.

Further, the arc tube 1 is formed to such a size that the lowest temperature of the arc chamber is 800° C. or higher and the highest temperature of the arc chamber is 1200° C. or lower during lighting.

Temperature in each of the portions of the arc chamber is determined by the bulb wall loading of the arc tube, the gas pressure in the translucent outer tube, the material of the arc tube, and the dimensional ratio (L/D) of the arc chamber.

"The bulb wall loading" is defined by a value obtained by dividing a lamp power $P_L$ (W) with an entire inner area S ($cm^2$) of the arc chamber 2.

The distribution of the wall thickness in the arc chamber 2 is defined such that it is within ±20% of an average wall thickness.

In this embodiment, minimum wall thickness $t_{min}$=0.78 mm and maximum wall thickness $t_{max}$=0.98 mm for average wall thickness $T_{av}$=0.85 mm Since the allowable minimum wall thickness $t_{av}$−20%=0.68 mm, and the allowable maximum wall thickness $t_v$+20%=1.02 mm, the thickness distribution is defined within the allowable wall thickness size of the average wall thickness ±20%.

In the arc tube 1, since the pair of the capillaries 3A, 3B is formed continuously on both ends of the arc chamber 2 formed substantially in an ellipsoidal shape in the direction of the longitudinal axis by way of transitional curved areas 4 with no angled corner, the wall thickness distribution can be made uniformly within a range of the average wall thickness ±20% as described above, and the tube wall loading necessary for keeping the lowest temperature in the arc chamber 2 of the arc tube to 800° C. or higher can be decreased.

Accordingly, the temperature difference in the arc chamber 2 can be decreased than usual and, as a result, this provides an effect capable of suppressing the rate of chemical reaction between the rare earth metal iodide and the material constituting the inner wall surface of the arc chamber to extend the lamp life.

In arc tubes of a type in which an arc chamber and a capillary portion are fabricated from three piece or five piece components separately and assembling them by shrink fit due to shrinkage during sintering of the arc tube, the thickness at the end of the arc chamber generally has a thickness 1.5 times as large as the thickness in the vicinity of the central portion of the arc chamber in order to ensure the mechanical strength upon shrink fit of the components.

In this case, since heat is dissipated more in the thick wall portion than in other portions, the temperature for the thick portion less tends to increase and the bulb wall loading has to be set higher in order to maintain the temperature of the portion (lowest temperature of the arc chamber) to 800° C. or higher and, as a result, temperature difference increases in the arc chamber.

When the bulb wall loading is set higher, the highest temperature of the arc chamber exceeds 1200° C. and, as a result, the rate of chemical reaction between the metal halide and the material constituting the inner wall surface of the arc tube at the high temperature portion is increased to issue a problem that erosion is promoted at the inner wall surface of the arc tube and the lamp life is shortened.

The ceramic metal halide lamp of the invention can attain high efficiency and high color rendition.

Further, in the arc chamber 2, at least thulium iodide ($TmI_3$), thallium iodide (TlI), sodium iodide (NaI), and calcium iodide ($CaI_2$) are sealed as the metal halide, and sodium iodide (NaI) and calcium iodide ($CaI_2$) are sealed by the molar ratio of 40 to 80% and less than 30%, respectively, based on the entire metal halide.

Optionally, dysprosium iodide ($DyI_3$) is sealed by the molar ratio of 3% or less based on the entire metal halide, and cerium iodide ($CeI_3$) is sealed by the molar ratio of 5% or less based on the entire metal halide.

<Metal Halide Lamp A>

Figure 2:
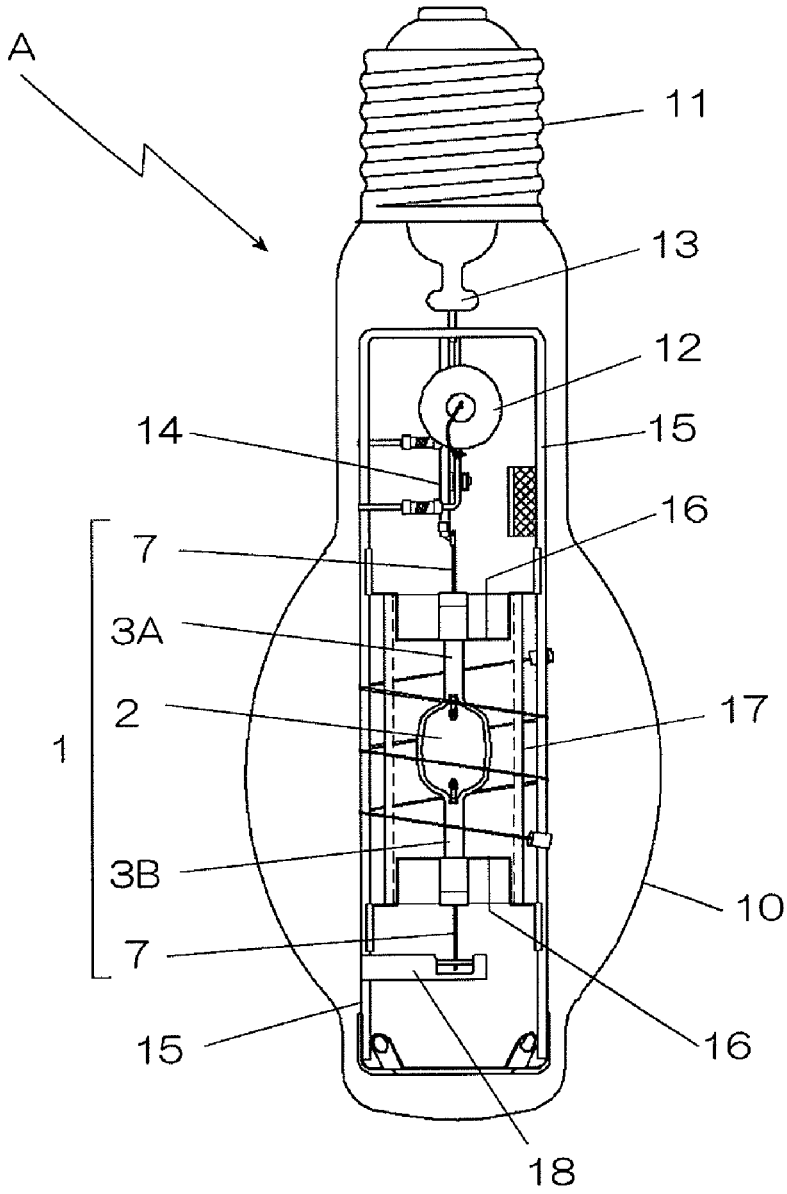
FIG. 2 is an entire outer looking view of a metal halide lamp A.

In a metal halide lamp A, as shown in FIG. 2, the arc tube 1 described above is disposed and the starter 12 comprising, for example, a non-linear ceramic capacitor is disposed in an outer tube 10 having a base 11 formed at one end for supplying a starting voltage between the electrodes 5 and 5.

Then, support studs 14, 15 are disposed vertically to a stem 13 of the base 11, support disks 16, 16 are attached to the support stud 15, the capillaries 3A, 3B are inserted through the insertion holes formed at the center of them to thereby attach and support the arc tube 1, and a translucent sleeve 17 is secured to the disks 16, 16 so as to surround the arc chamber 2.

Further, power feed leads 7, 7 protruding from the ends of the capillaries 3A, 3B are electrically connected to the base 11 by direct welding to the respective support studs 14, or welding by way of a nickel ribbon wire 18, and the starter 12 is electrically connected to the power feed leads 7, 7.

The inside of the outer tube 10 is at 0.6 atm in a state of room temperature, the bulb wall loading is 15 to 25 ($W/cm^2$), and the lamp is lit being held in a vertical direction (direction in FIG. 2).

<Metal Halide Lamp B>

Figure 3:
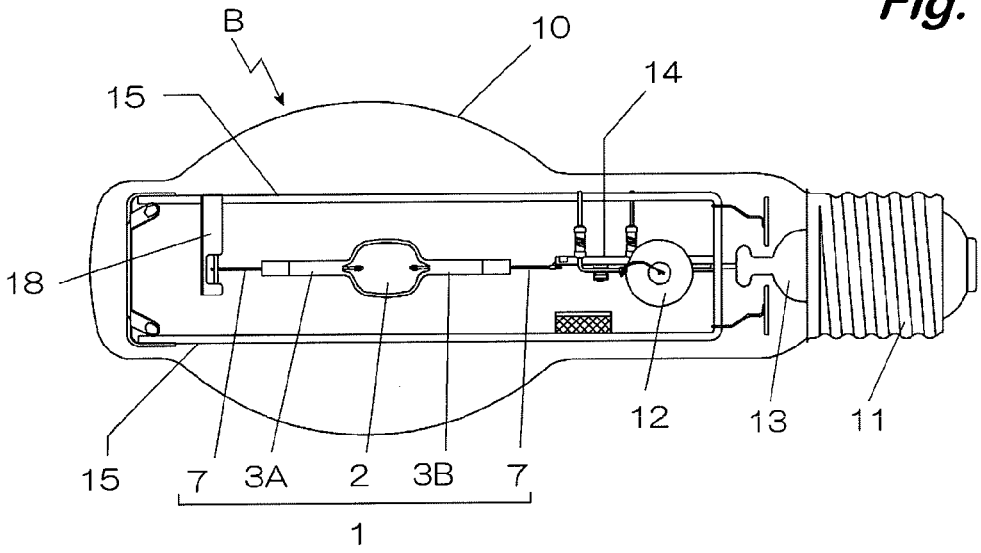
FIG. 3 is an entire outer looking view of a metal halide lamp B.

As shown in FIG. 3, a metal halide lamp B is identical with the metal halide lamp A in view of a basic structure of housing the arc tube 2 and the starter 12 in the outer tube 10 and is different only in that it has no translucent sleeve 16 and the inside of the outer tube 10 is kept in vacuum. Components in common with those of the metal halide lamp A carry the same reference numerals and detailed description therefor is to be omitted.

The bulb wall loading is 17 to 22 ($W/cm^2$) and the lamp is basically of a type which is lit being held in a horizontal direction (direction in FIG. 3).

<Metal Halide Lamp C>

A metal halide lamp C is a both base type lamp having bases 21 formed on both ends, which is a type where the arc tube 1 is contained in a straight tubular outer tube 20 maintained in vacuum, having no translucent sleeve surrounding the arc chamber 2, and not incorporating the starter.

Power feed leads 7, 7 protruding from the ends of the capillaries 3A, 3B of the arc tube 1 are electrically connected with the bases 21 by being welded to support metals 23, 23 each formed of a U-shaped leaf spring secured to each of the support studs 22, 22 disposed vertically to the bases 21, 21.

Figure 4:
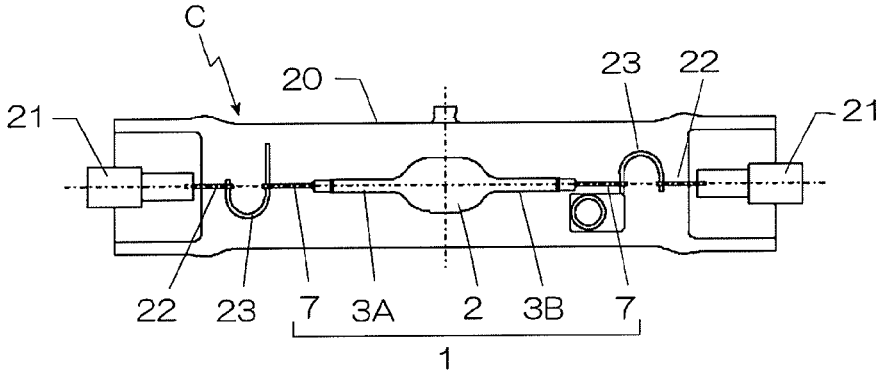
FIG. 4 is an entire outer looking view of a metal halide lamp C.

The bulb wall loading is 24 to 29 ($W/cm^2$) and, basically, this is a type which is lit being held in a horizontal direction (direction in FIG. 4).

<Experimental Result>

For each of the metal halide lamps A to C, average color rendering index Ra and the luminous efficiency η were measured at L/D=2, while varying the compositional ratio of the metal halides sealed in an arc chamber 2. The result is shown in Table 1.

In each of the cases, the average rendering index was in a range of: Ra≧80 and the luminous efficiency of: η=100 (1 m/W) could be attained while maintaining the color rendering section according to ISO 8995 of 1B or higher.

TABLE 1

| | | No. 1 | No. 2 | No. 3 | No. 4 | No. 5 | No. 6 | No. 7 | No. 8 |
|---|---|---|---|---|---|---|---|---|---|
| Lamp type | | A | A | A | A | A | B | B | C |
| lighting direction | | vertical | vertical | vertical | vertical | vertical | horizontal | horizontal | horizontal |
| Rated power | | 230 W | 230 W | 270 W | 270 W | 360 W | 180 W | 220 W | 110 W |
| Total of metal halides | | 9.2 mg | 7.0 mg | 16.2 mg | 10.5 mg | 10.5 mg | 10.6 mg | 15 mg | 4 mg |
| Molar ratio | $TmI_3$ | 16.8% | 13.0% | 18.5% | 13.0% | 13.0% | 11.2% | 10.7% | 9.6% |
| | TlI | 12.7% | 7.2% | 10.4% | 7.2% | 7.2% | 4.9% | 4.4% | 6.4% |
| | NaI | 43.2% | 68.9% | 54.2% | 68.9% | 68.9% | 79.1% | 78.2% | 70.2% |
| | $CaI_2$ | 25.6% | 6.5% | 14.1% | 6.5% | 6.5% | 2.1% | 2.5% | 10.8% |
| | $DyI_3$ | 1.7% | 0.0% | 2.8% | 0.0% | 0.0% | 0.0% | 0.0% | 0.0% |
| | $CeI_3$ | 0.0% | 4.6% | 0.0% | 4.6% | 4.6% | 2.7% | 4.2% | 3.0% |
| | Total | 100.0% | 100.0% | 100.0% | 100.0% | 100.0% | 100.0% | 100.0% | 100.0% |
| Average color rendering index | | 82 | 80 | 82 | 81 | 80 | 83 | 83 | 92 |
| Luminous efficiency | | 104 | 119 | 111 | 120 | 125 | 120 | 120 | 120 |

Figure 5:
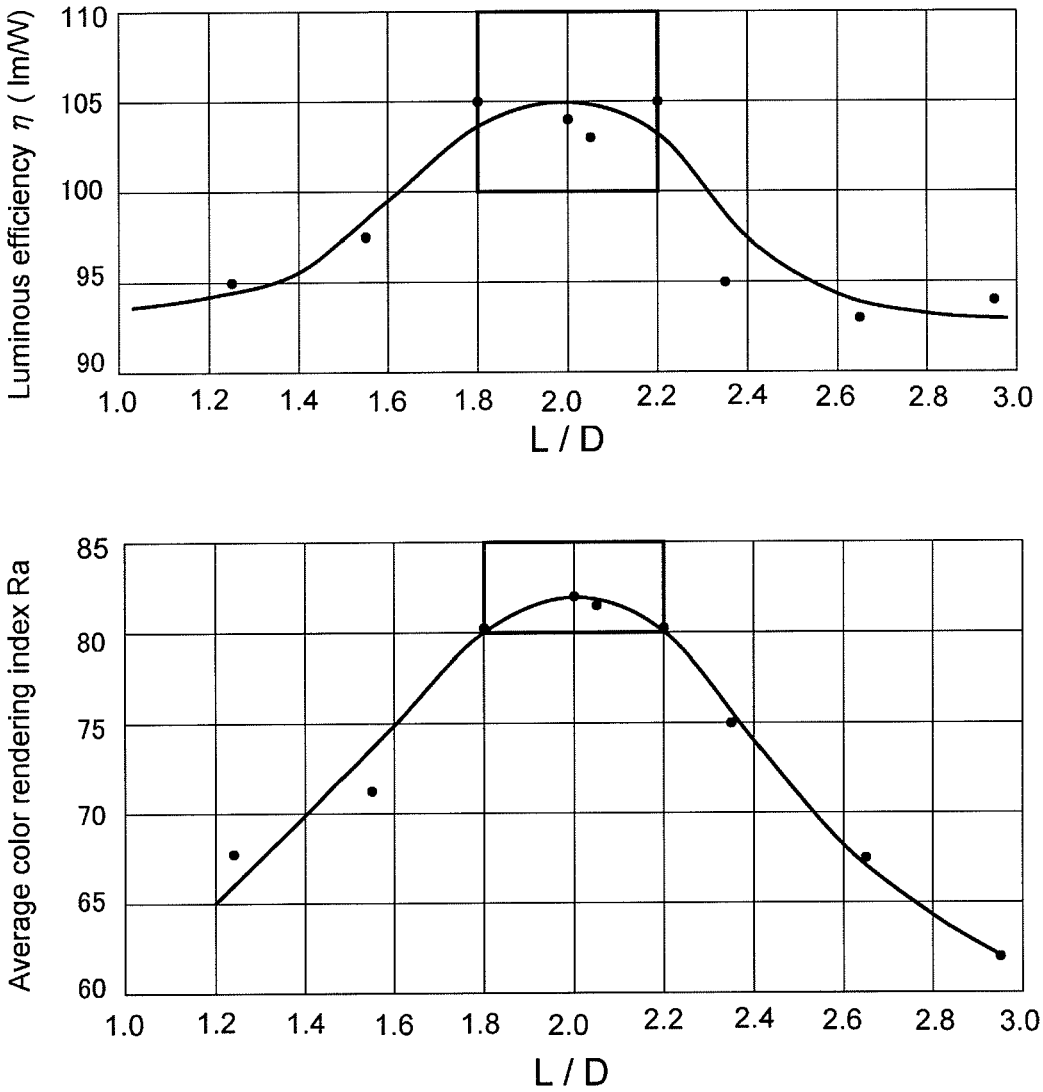
FIG. 5 is a graph showing a relation between a luminous efficiency $\eta$ and L/D.
Figure 6:
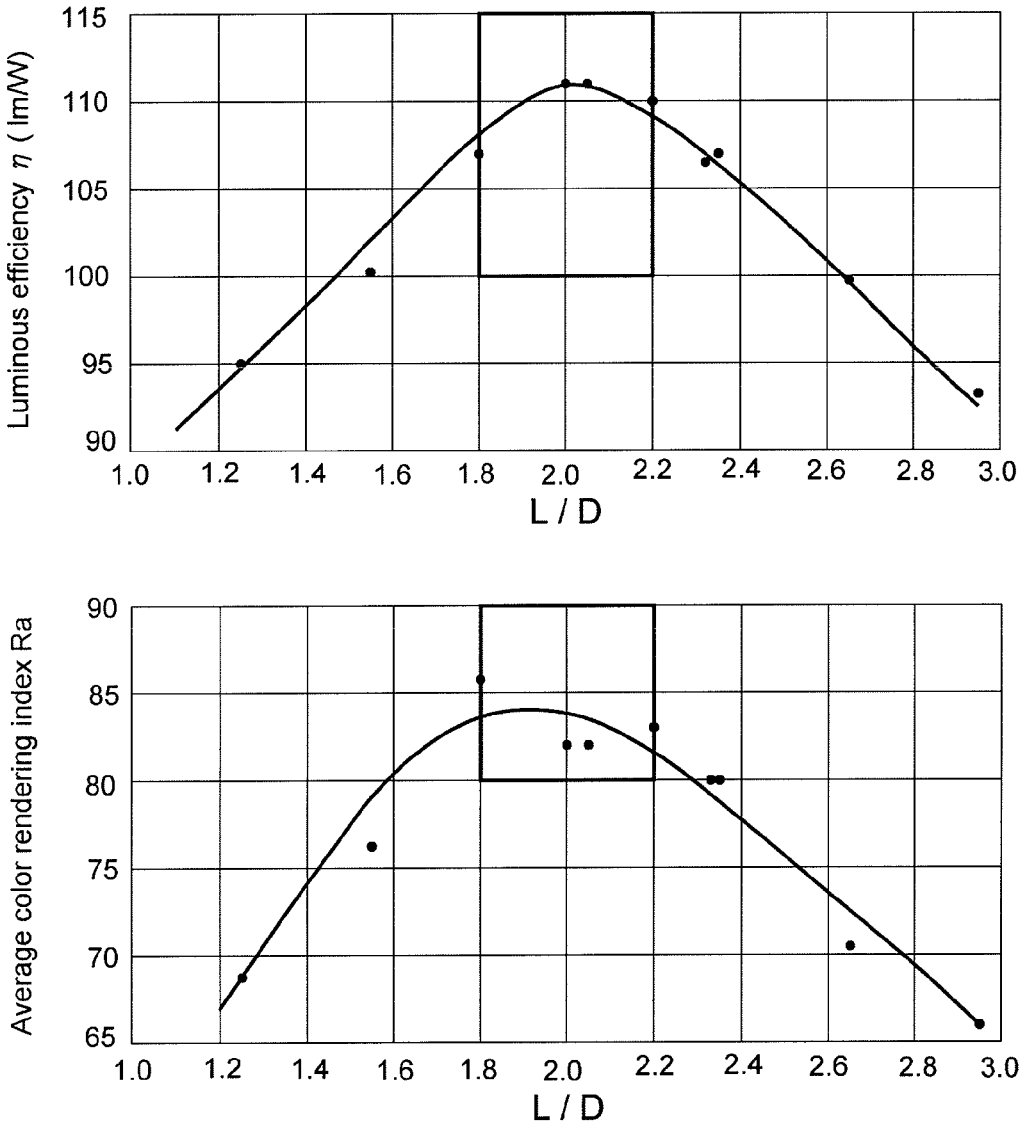
FIG. 6 is a graph showing a relation between an average color rendering index Ra and L/D.

FIG. 5 and FIG. 6 are graphs showing relations between L/D and the average rendering index Ra, and between luminous efficiency η and L/D in a case of filling metal halides by a predetermined molar ratio in the arc tubes 1 of different L/D ratios in the metal halide lamp A. FIG. 5 shows the result of measurement when they were sealed by a molar ratio of No. 1 in Table 1, and FIG. 6 shows the result of measurement when they were sealed by a molar ratio of No. 3 in Table 1.

According to the graphs, the average rendering index was in a range of: Ra≧80 and the luminous efficiency was in a range of: η≧100 (1 m/W) at least in the range of: 1.8≦L/C≦2.2. Similar results were obtained also in other examples although the graphs are not shown.

Since each of approximate curves shows a peak in the vicinity of: L/D=2, it is preferred to use the arc tube 1 at L/D=2 in order to maintain both the average rendering index Ra and the luminous efficiency η at high levels when measuring error, etc. are taken into consideration.

Figure 7:
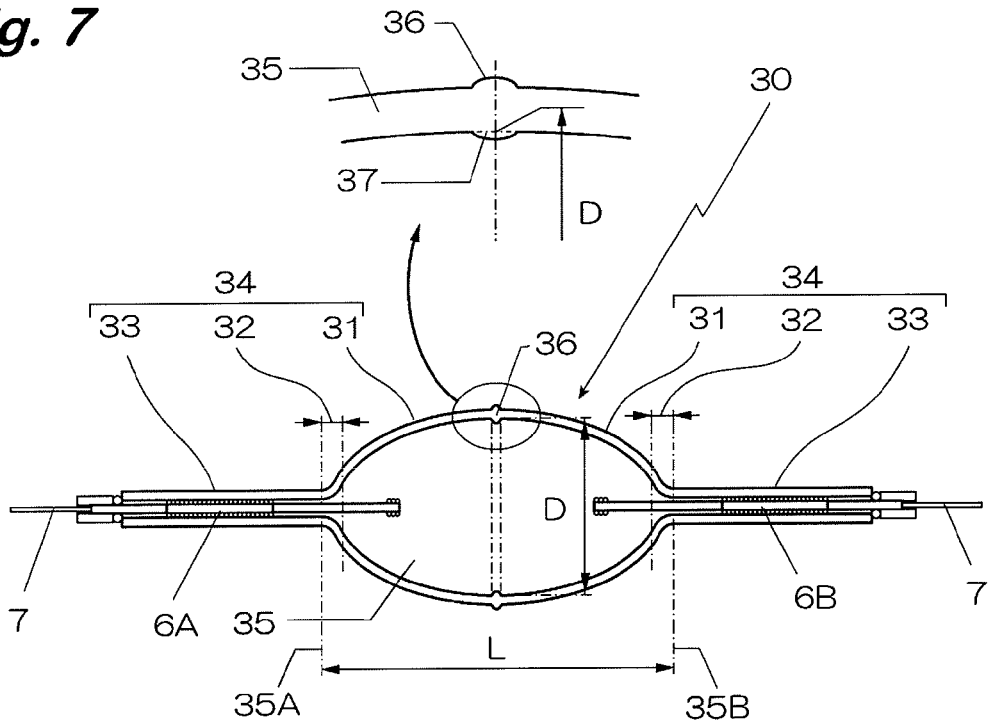
FIG. 7 is an explanatory view showing another embodiment of an arc tube.

In the foregoing description, while one piece type arc tube 1 was used, a two piece type may also be used so long as capillaries are formed continuously on both ends of the arc chamber formed substantially in an ellipsoidal shape in the direction of the longitudinal axis by way of transitional curved areas with no angled corner As shown in FIG. 7, a two piece type arc tube 30 is foamed by butt-welding funnel-shaped arc tube forming half-members 34 in which one capillary 33 is formed continuously on each side of the apex of a substantially semi-ellipsoidal area 31 by way of a transitional curved area with no angled corner.

In this case, the effective length L of the arc chamber 35 is defined as a distance between portions 35A and 35B where the inner diameter of the straight tubular capillary 33 transits to the transitional curved area 32 contiguous to the arc chamber 35 and starts to enlarge the diameter in the same manner as in the arc tube 1 of FIG. 1.

Since the thickness increases at the butt-welded portion 36, the effective inner diameter D is defined as the maximum inner diameter at the central portion between the electrodes at an imaginary ellipsoidal area 37 assuming that the welded portion 36 has no inward bulging.

The ratio of the effective length L to the effective diameter D is defined as 1.8≦L/D≦2.2.

In the two piece type arc tube 30, when lighting experiment was performed by mounting an arc tube in which the thickness distribution of the arc chamber 35 was defined as within ±20% of the average thickness that was calculated excluding the thick wall portion of the butt-welded portion 36, and the thick wall portion was formed to a thickness 1 to 1.5 times as large as the average thickness, instead of the arc tube 1 described above, to the metal halide lamps A-C, high color rendition of an average rendering index within a range of: Ra≧80 and a high luminous efficiency within a range of: η≧100 (1 m/W) could be made compatible in the same manner as in each of the examples described above.

INDUSTRIAL APPLICABILITY

As has been described above, the present invention is applicable to the use of ceramic metal halide lamps requiring high rendition property and high luminous efficiency.

DESCRIPTION OF REFERENCES

| | |
|---|---|
| A-C | metal halide lamp |
| 1 | arc tube |
| 2 | arc chamber |
| 3A, 3B | capillary |
| 4 | transitional curved area |
| 6A, 6B | electrode assembly |
| L | effective length |
| D | effective inner diameter |

The invention claimed is:

1. A ceramic metal halide lamp having an arc tube, comprising an arc chamber where a metal halide, mercury, and a starting gas are sealed, and a pair of capillaries each having an electrode assembly inserted therethrough disposed on both ends of the arc chamber, the arc tube and the arc chamber being formed of translucent ceramics, wherein the capillary is formed continuously to each end of the arc chamber formed substantially in an ellipsoidal shape in the direction of the longitudinal axis by way of a transitional curved area with no angled corner, the inner dimension of the arc chamber is designed as:

$$1.8 \leqq L/D \leqq 2.2$$

where

L is an effective length and

D is an effective inner diameter, and the arc chamber is formed to a size that the lowest temperature in an arc chamber is 800° C. or higher and the highest temperature in the arc chamber is 1200° C. or lower during lighting, and at least thulium iodide, thallium iodide, sodium iodide, and calcium iodide are sealed as the metal halides, and sodium iodide and calcium iodide are sealed by a molar ratio of 40 to 80% and less than 30%, respectively, based on the entire metal halide.

2. A ceramic metal halide lamp according to claim 1, wherein dysprosium iodide is sealed as the metal halide by a molar ratio of 3% or less based on the entire metal halide.

3. A ceramic metal halide lamp according to claim 1, wherein cerium iodide is sealed as the metal halide by a molar ratio of 5% or less based on the entire metal halide.

4. A ceramic metal halide lamp according to claim 1, wherein the wall thickness distribution of the arc chamber is defined as within ±20% of an average wall thickness in a case where the arc tube is a one piece type in which a pair of capillaries are formed integrally on both ends of the arc chamber.

5. A ceramic metal halide lamp according to claim 1, wherein the wall thickness distribution of the arc chamber is defined as within ±20% of an average wall thickness which is calculated while excluding the wall thickness of a butt-welding zone in a case where the arc tube is a two piece type formed by butt-welding funnel type arc tube forming half-members in which a capillary is formed continuously on the side of the apex of a substantially semi-ellipsoidal shape by way of a transition curved area with no angled corner.

6. A ceramic metal halide lamp according to claim 5, wherein the wall thickness of the butt-welded zone is 1 to 1.5 times as large as an average wall thickness.

* * * * *